US006881047B2

(12) United States Patent
Smith et al.

(10) Patent No.: US 6,881,047 B2
(45) Date of Patent: Apr. 19, 2005

(54) PROCESS AND APPARATUS FOR IMPROVED CONDITIONING OF MELT-SPUN MATERIAL

(75) Inventors: Steven Wayne Smith, Waynesboro, VA (US); Geoffrey David Hietpas, Newark, DE (US); Richard Terry Wood, Charleston, SC (US)

(73) Assignee: Invista North America S.a.r.l., Wilmington, DE (US)

( * ) Notice: Subject to any disclaimer, the term of this patent is extended or adjusted under 35 U.S.C. 154(b) by 25 days.

(21) Appl. No.: 09/855,343

(22) Filed: May 15, 2001

(65) Prior Publication Data

US 2002/0051880 A1 May 2, 2002

Related U.S. Application Data

(60) Provisional application No. 60/205,072, filed on May 18, 2000.

(51) Int. Cl.[7] ..... D01D 5/096; D01D 5/092

(52) U.S. Cl. ..... 425/72.2; 425/94; 425/104; 425/DIG. 115

(58) Field of Search ..... 425/72.2, 90, 94, 425/104, 382.2, 378.2, 464, DIG. 115, 72.7

(56) References Cited

U.S. PATENT DOCUMENTS

| | | | | | |
|---|---|---|---|---|---|
| 3,754,530 | A | | 8/1973 | Pierce | 118/420 |
| 4,038,357 | A | | 7/1977 | Boyes et al. | 264/168 |
| 4,156,071 | A | * | 5/1979 | Knox | 528/308.2 |
| 4,285,646 | A | | 8/1981 | Waite | 425/72.2 |
| 4,491,082 | A | | 1/1985 | Barch et al. | 118/234 |
| 4,687,610 | A | * | 8/1987 | Vassilatos | 264/211.14 |
| 4,756,679 | A | | 7/1988 | Stibal et al. | 425/72.2 |
| 5,536,157 | A | * | 7/1996 | Linz | 425/72.2 |
| 5,612,063 | A | | 3/1997 | Schilo et al. | 425/72.2 |
| 5,679,158 | A | | 10/1997 | Holzer, Jr. et al. | 118/407 |
| 5,866,055 | A | * | 2/1999 | Schwarz et al. | 264/103 |
| 2002/0119210 | A1 | * | 8/2002 | Maas et al. | 425/72.2 |

FOREIGN PATENT DOCUMENTS

| | | | | | |
|---|---|---|---|---|---|
| DE | 19800636 | C1 | * | 7/1999 | D01D/5/088 |
| DE | 10105440 | A1 | * | 8/2002 | D01D/5/088 |
| JP | 07118912 | | * | 5/1995 | D01D/5/092 |
| JP | 10077522 | | * | 3/1998 | D01D/11/04 |
| WO | WO0188233 | A1 | * | 11/2001 | D01D/5/088 |

* cited by examiner

*Primary Examiner*—Joseph S. Del Sole
(74) *Attorney, Agent, or Firm*—Charles E. Krukiel

(57) ABSTRACT

An apparatus and process for applying finish to an expanded filament array in a quench system with air directed inward to the filament bundle. The applicator may be used inside or proximate quench zones in a radial, pneumatic, or cross-flow quench system. The apparatus includes a spinneret, a quench zone located below said spinneret, wherein cooling gas is directed inward to an expanded filament array inside said quench zone, and an applicator inside or below said quench zone, wherein the applicator contacts the filament and delivers the finish to the expanded filament array.

14 Claims, 2 Drawing Sheets

PROCESS AND APPARATUS FOR IMPROVED CONDITIONING OF MELT-SPUN MATERIAL

FIELD OF THE INVENTION

The invention relates to a method for the production of polymeric filaments, the filaments, yarn, and other articles produced by the method, and an apparatus to improve filament quenching and fiber uniformity while delivering conditioning oil to the extruded filaments.

DESCRIPTION OF RELATED ART

Most synthetic polymeric filaments, such as polyesters, are melt-spun, i.e., they are extruded from a heated polymeric melt, i.e., a polymer delivery source. Melt-spun polymeric filaments are produced by extruding a molten polymer, such as polyethylene terephthalate and related polyesters, through a spinneret with a plurality of capillaries, which can range in number, for example, from 200 to up to 10,000. The filaments exit the spinneret and are then cooled in a cooling zone. The details of the cooling and subsequent solidification of the molten polymer can have a significant effect on the quality of the spun filaments, as indicated by inter-filament uniformity and their ability to be collectively drawn in tow form typical for staple processing.

A commonly practiced cooling technique, referred to as radial quench, includes cooling of an annular array of filaments by introduction of a cooling gas, usually air, radially inward to cool the filaments. Such cooling air typically originates from a cylindrical porous media, such as a screen, outside the annular filament bundle and flows inwardly through the screen perpendicular to the filaments. Subsequent to cooling, the filaments pass over a rotating guide, which applies finish oil to the filaments. Such quench air delivered internally to the spinning filament bundle must later be removed in order for the bundle to be consolidated for further processing. Quench-air removal from the bundle can produce a significant amount of air turbulence and threadline fluctuation, which are significant sources of undesirable filament variability.

In a typical commercial process for producing polyester filaments, freshly spun filaments, in an array or bundle corresponding to the array of capillaries in the spinneret, move continuously through a quench zone and then over a tangential applicator roll which applies a finishing liquid to each filament as it passes over it. The applicator roll is stationary and positioned off-center with respect to the center line of the moving filament bundle, which creates a fixed and somewhat inclined thread path. In operation, the filament bundle is collapsed against the applicator roll to receive the finishing liquid. The stationary nature of the applicator roll means, furthermore that the gradient according to which the molten filaments are quenched, i.e., cooled, is also fixed. In this type of configuration significant turbulence can be created by the filament bundle collapsing against the applicator roll.

There is an ongoing need to improve inward-directed quench systems through improved methods for stabilizing the filament bundle, eliminating or reducing air turbulence, reducing filament movements and inter-filament mass variability, improving orientation uniformity of continuous filament processes, improving liquid finish application, increasing productivity, and lowering production cost.

SUMMARY OF THE INVENTION

In accordance with these needs there is provided a process and apparatus for conditioning melt-spun material.

The present invention improves quench systems by stabilizing the filament bundle with the use of a finish applicator to easily and uniformly extract from the system the delivered quench air.

The present invention stabilizes the free filaments as extruded in annular form and shortens unsupported filament length. This effects a reduction in the potential amplitude of filament vibrations, whereby the filaments are quenched in a more uniform manner.

The present invention provides a melt spinning apparatus for spinning continuous polymeric filaments including:

(a) a spinneret having a plurality of capillaries;

(b) a polymer delivery source which is arranged to communicate communicated with said spinneret and deliver molten polymer therethrough to produce a continuously moving array of molten polymeric filaments corresponding to the arrangement of capillaries in the spinneret;

(c) a quench zone positioned below said spinneret and arranged to receive and cool the array of molten filaments as they move therethrough by passing a cooling gas inward with respect to the array of moving filaments; and (d) a finish applicator positioned inside or below the quench zone to apply an amount of finishing liquid to the array, wherein said finish applicator comprises (i) a base plate having a peripheral edge which corresponds to the cross-section of the array of moving molten filaments; and (ii) a body portion having a top and bottom concentric therewith and connected to said base plate, wherein said bottom corresponds in shape to the shape defined by the peripheral edge of the base plate, and the surface formed by a plurality of lines drawn between said top and said bottom tapers outwardly with respect to the direction of movement of the filament array.

There is also provided an applicator for applying finish to a moving expanded polymeric filament array comprising a base plate having a peripheral edge which corresponds to the cross-section of the filament array and a body portion having a top and bottom concentric therewith and connected to said base plate, wherein said bottom corresponds in shape to the shape defined by the peripheral edge of the base plate, and the surface formed by a plurality of lines drawn between said top and said bottom tapers outwardly with respect to the direction of movement of the filament array.

There is also provided a melt spinning process for spinning continuous polymeric filaments, comprising:

passing a polymeric melt through a spinneret to form an array of polymeric filaments;

passing the filament array to a quench zone and providing a cooling gas directed inward toward said array to cool the filaments;

passing said filaments over a finish applicator positioned in or below said quench zone and arranged to contact the filaments and to deliver finish to the filaments.

The invention also provides filaments, yarns, and articles produced according to the process.

Further objects, features and advantages of the invention will become apparent from the detailed description that follows.

DETAILED DESCRIPTION OF THE PREFERRED EMBODIMENTS

Figure 1:
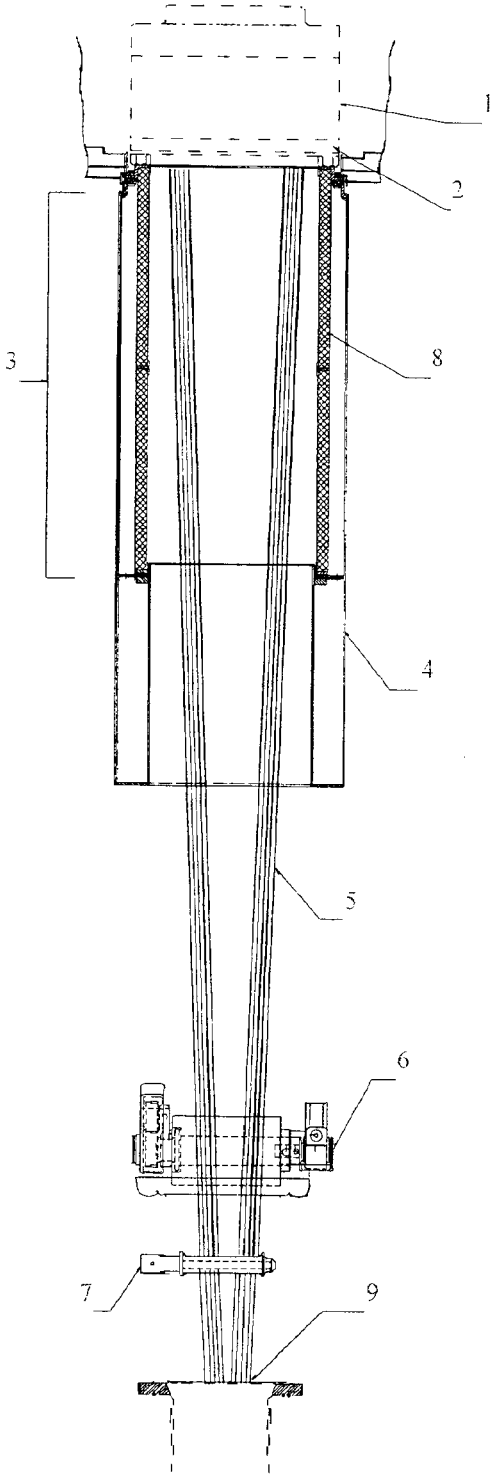
FIG. 1 Prior Art
FIG. 1 is a diagrammatical view of a conventional melt-spinning process and apparatus.

In FIG. 1 there is depicted a conventional melt-spinning apparatus. Molten polymer having the desired relative viscosity at a temperature of about 20° C. to about 30° C. above the melting point is supplied from a polymer delivery source using an extruder (not shown) to a spin pack 1 with multi-capillary spinneret plate 2 with 200–10,000 capillaries. The molten polymer is extruded through the spinneret plate 2 into multiple melt streams. Cooling gas of near-ambient temperature is passed through a quench screen 8 and introduced to the melt streams that are cooled in a quench zone 3 to form filaments 5. The filaments 5 are coalesced and brought into contact with a rotating roll finish applicator 6 and convergence guide 7 into a yarn 9. A covered section 4 may be included after the quench zone 3 to reduce turbulence caused by ambient room conditions. The yarn 9 is withdrawn from the quench zone by a pair of unheated feed godet rolls (not shown). The rotating roll finish applicator 6, partially immersed in a liquid bath, achieves application of the coating liquid when the coalesced filament bundle comes in contact with the roll. The finish application is subject to variability as the coating liquid must migrate through, or wrap around the filament bundle to achieve uniform coverage.

Additionally, variability occurs due to contact variation of the traveling filaments and excessive air turbulence as filament arrays coalesce in and around the rotating roll finish applicator 6. Furthermore, the point of application is generally stationary and cannot be optimally positioned for improved process or product quality.

The present invention provides an apparatus and process that allow for the production of melt-spun filaments and improved quench and finish uniformity in, for example, a radial quench system with air directed inward to an annular filament bundle. Any radial quench system known in the art can be used. See, for example, U.S. Pat. Nos. 4,156,071; 5,250,245; and 5,288,553, each incorporated herein by reference. The invention is not limited to radial quench systems and may also be used for cross-flow, pneumatic, and other quench systems used to cool an array of filaments. The system is also not limited to systems having a strictly annular filament array. The applicator of the present invention could be adapted to be used in various geometries, such as rectangular, oval, etc., so long as the applicator is placed within an expanded array, and contacts the filaments of the array to apply finish.

Cross-flow quench that can be used in the invention involves blowing cooling gas transversely across from usually one side of a freshly extruded filamentary array. Much of the cross-flow air passes through and out the other side of the filament array. However, depending on various factors, some of the air may be entrained by the filaments and be carried down with them towards a puller roll, which is driven and is usually at the base of each spinning position.

U.S. Pat. Nos. 4,687,610, 4,691,003, 5,141,700, 5,034,182 and 5,824,248, each incorporated herein by reference in their entirety, describe gas management techniques, commonly referred to as "pneumatic quench", whereby gas surrounds the freshly extruded filaments to control their temperature and attenuation profiles. Such quench systems can be used in the present invention. Pneumatic quench involves introducing a gas in a zone below a spinneret from which a polymeric multi-filament melt emerges. The volume of air and the filament bundle that is surrounded by the air is then generally passed through a tapered device having a passageway that converges to a small circular exit on the bottom of the device, thus accelerating the air as it moves through the passageway and creating an opportunity for the moving air stream to exert a pulling force on the still molten filaments and attenuating the filaments in a melt.

The apparatus of the invention can be used to apply any desired finishing oil to the filament array. Freshly spun filaments are treated with suitable finishing oil to reduce friction and eliminate static charge development common to high speed fiber processing. The apparatus of the invention is capable of accurately delivering any type of finish or conditioning oil either as a concentrate, or in the form of a dilute aqueous emulsion. The conditioning oil is preferably in a liquid state, which is defined as any oil or mixture of oils with a solidification point below the temperature of application.

Figure 2:
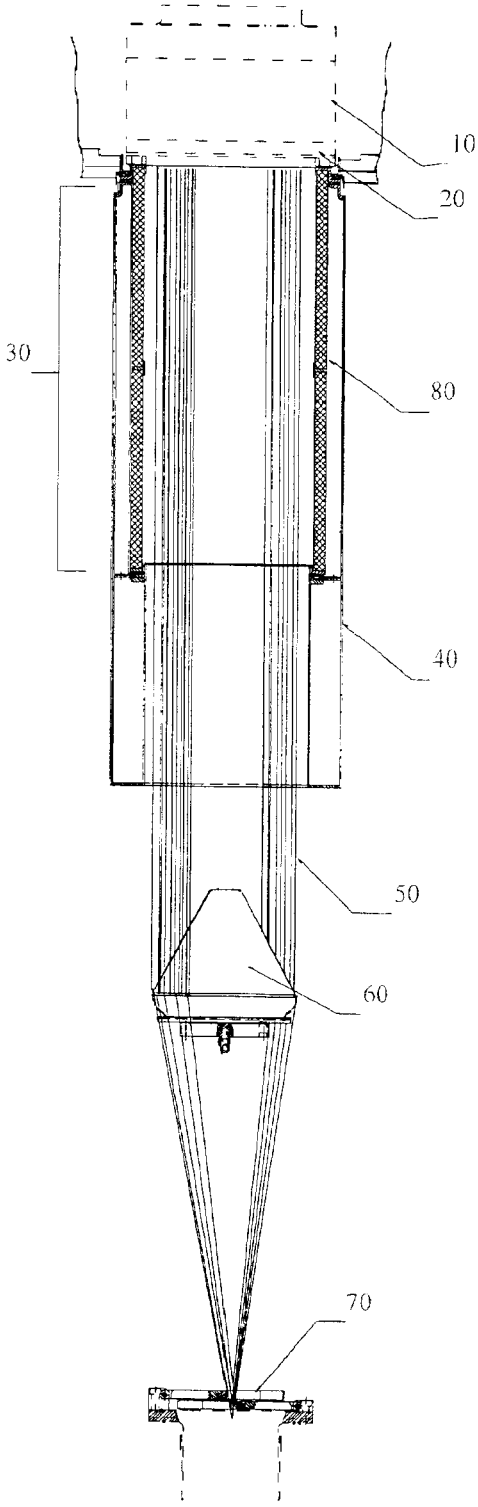
FIG. 2 is a diagrammatical view of a general layout of a melt-spinning process and apparatus in accordance with the present invention.

An exemplary embodiment of the process and apparatus of the present invention is depicted in FIG. 2. Molten polymer having the desired relative viscosity is supplied from a polymer delivery source using an extruder (not shown) to a spin pack 10 with multi-capillary spinneret plate 20 with 200–10,000 capillaries. Cooling gas is passed through a quench screen 80 and introduced to the filament array 50 in a quench zone 30, preferably beginning within about 5 mm to about 45 mm from the spinneret plate 20 and extending downward towards finish applicator 60, preferably from about 100 mm to about 1,000 mm, with a uniform or profiled air velocity directed inward to the filament array 50. The portion of the quench zone closest to the spinneret plate 20 may also incorporate a heating device or delay portion to delay cooling for enhanced product attributes. A covered section 40 may be included after the quench zone 30 to reduce turbulence caused by ambient room conditions.

The apparatus of the invention includes a finish applicator 60. The finish applicator 60 can be as close as about 120 mm to about 200 mm below the spinneret plate 20 with the preferred location being about 200 mm to about 400 mm below the end of the quench zone 30. For a cross-flow or pneumatic quench system, the finish applicator 60 may be located inside the quench zone 30. For a given inner and outer spinneret array diameter, the preferred dimension of the finish applicator lies in the range between about 70% and about 120% of the outer-most filament dimension. The preferred applicator dimensions maintain inter-filament separation, which permits entrained air to be easily extracted from the system with minimal turbulence.

Figure 3:
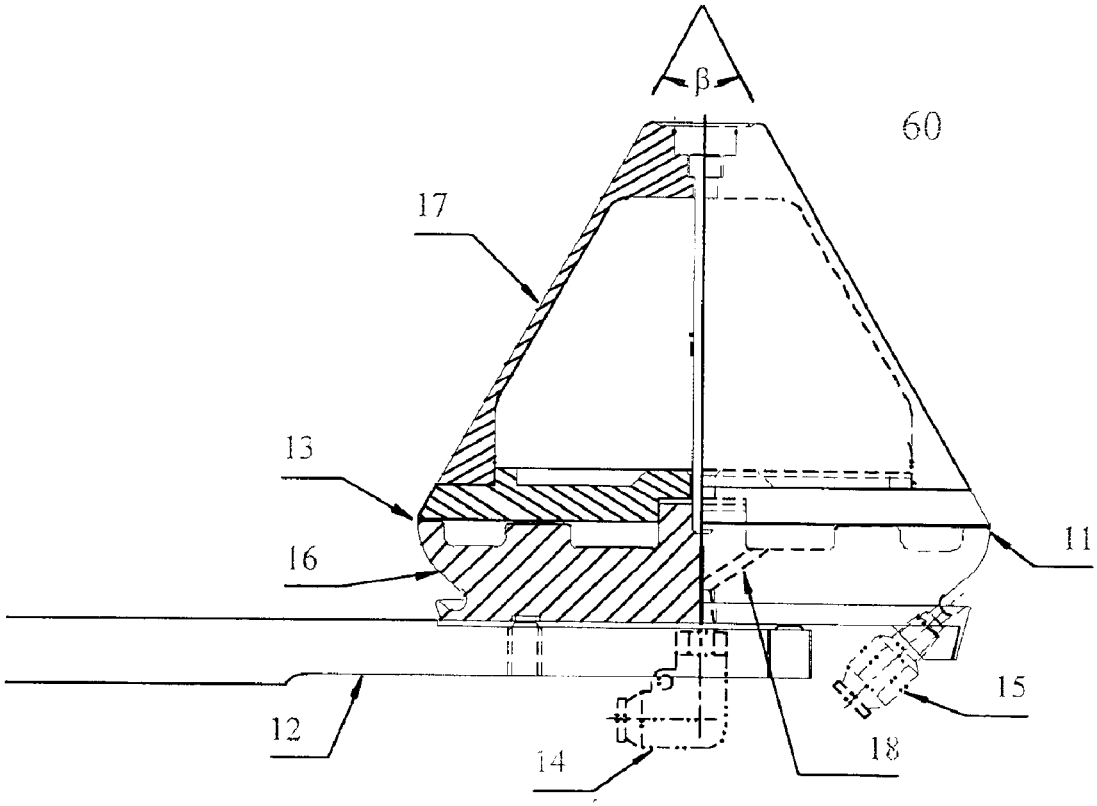
FIG. 3 is a cross-sectional view of a finish applicator in accordance with the present invention.

An exemplary finish applicator 60 is shown in greater detail in FIG. 3. The applicator includes a base plate portion A and a body portion B. The base portion has a peripheral edge contact surface 11 that contacts the filament array. Thus, the base plate should have a cross section corresponding to that of the array of filaments, such that the array of filaments can be contacted. The body portion preferably tapers outward as shown in FIG. 2.

The shape of the finish applicator 60 may vary with desired process applications and polymer type, but a tapered shape is especially desirable so as to remove the deposited quenching air. The preferred tapered surface smoothly deflects accumulated air from inside the filament array to outside. In the preferred embodiment the applicator shape provides a gradient surface for the gradual removal of quench air in a radially uniform manner. The tapered or conical shaped body 17 may have an angle β ranging from about 170 to about 45 degrees with the preferred angle ranging from about 60 to about 90 degrees. In a preferred embodiment, a flat plate assembly 16 having a peripheral delivery slot 13 for delivering finish to the expanded annular filament array is connected to a peripheral fiber contact surface 11 on an outer surface. The finish applicator 60 may additionally contain a drainage aperture 15, to remove excess finish.

The finish applicator 60 can be mounted on a support arm 12 arranged for linear movement to insert the applicator into the filament array during production and to remove the applicator in case of a disruption in the spinning process. Any linear motion device allowing for removal of the applicator from the filaments can be used. The linear motion device or support arm 12 may be positioned and adjusted as required for improved process or product quality. The support arm can also be adapted to move the finish applicator 60 up or down in the filament array.

The support arm 12 may be manually, pneumatically, or electrically driven and arranged in any manner such as to minimize interference with the normal path of the threadline. In the preferred location, the finish applicator 60 stabilizes the free filaments 50 as extruded in annular form, shortens the unsupported filament length, and reduces the amplitude of filament vibrations, whereby the filaments 50 are solidified or stabilized in a uniform manner.

The filaments 50 contact the finish applicator 60 on the wetted circumference of the finish applicator 60 at the peripheral fiber contact surface 11 where finishing oil can be continuously renewed from a peripheral delivery slot 13 supplied by inlet 14. Finish delivered through the inlet 14 moves upward through a supply channel 18 and then proceeds to move radially outward to the peripheral delivery slot 13. Liquid supply can be provided by, including but not limited to, a tank, a metering pump, or a pressurized header. The support arm 12 and peripheral fiber contact surface 11 can be coated with a wear resistant ceramic oxide or other suitable high strength material, which operates to protect the applicator wear surfaces from continuous sliding contact with the moving filaments. Examples of such surface treatment for improved wear resistance include anodization and vapor deposition of chromium and/or aluminum oxide, titanium or silicon nitrides. Furthermore, the arrangement of the quench air entering from the outside of the filament array facilitates operation and eliminates handling of molten or unquenched filament bundles as the quenching and finish application processes are decoupled.

After initial process start-up, when the filaments 50 have a spinning tension in excess of 20 mg/denier provided by driven rolls or aspirators, the finish applicator 60 is inserted into the spinning threadline to produce acceptable final product. The position of the finish applicator 60 is determined by the filament count (which is a function of the denier per filament), quench air velocity and position, and spinning speed, with lower counts being better suited for a higher finish applicator position. The increased spinning stability resulting from the finish applicator allows for improved process continuity, higher coolant flow rates, increased capillary density on the spinneret, and therefore, increased production capacity.

The finish applicator 60 is preferably radially symmetric, such that liquid delivery is spatially uniform and evenly applied to the advancing filaments. Application of the finish to an expanded filament array can deliver more complete fiber surface coverage as well as better consistency in the measured finish on fiber as compared to traditional roll applications. After application of the finish, the filaments are gathered by a suitable guide 70 for collection onto bobbins or in a can. The collected filaments can then be wound to form a package of continuous filament yarn or otherwise processed, e.g., collected as a bundle of parallel continuous filaments for processing, e.g., as a continuous filamentary tow, for conversion, e.g., into yarns or other textile processing.

The above description and the following examples give details of polyester filament preparation using a conical finish applicator according to the present invention. Polyester filaments, as typically prepared from a base polymer having an intrinsic viscosity of about 0.5 or greater, are extruded through a capillary of about 0.1 mm to about 0.5 mm in diameter and taken up at speeds ranging from about 1,000 m/min to about 8,000 m/min. Such useful polyesters include, polyethylene terephthalate (PET), polybutyene terephthalate (PBT or 4GT), polytrimethylene terephthalate (PTT or 3GT), and polyethylene naphthalate (PEN); and combinations thereof, including bicomponent polyester fibers such as those prepared from poly(ethylene terephthalate) including copolymers thereof, and poly (trimethylene terephthalate).

Fibers that can be used with the finish applicator of the present invention may comprise bicomponent fibers of a first component selected from the group consisting of poly (ethylene terephthalate) and copolymers thereof and a second component selected from the group consisting of poly (trimethylene terephthalate) and copolymers thereof, the two components being present in a weight ratio of 70:30 to 30:70. The cross-section of the bicomponent fibers can be side-by-side or eccentric sheath/core. However, the invention is not confined to polyester filaments, but may be applied to any melt-spinnable polymers, including, polyolefins, polyamides, and polyurethanes. The term "polymers" as used herein includes copolymers, mixed polymers, blends, and chain-branched polymers, just as a few examples. Also the term "filament" is used generically, and does not exclude cut fibers (often referred to as staple), although synthetic polymers are generally prepared initially in the form of continuous polymeric filaments as they are melt-spun.

EXAMPLES

The invention will now be exemplified by the following non-limiting examples. A melt spinning process with threadline in contact having a rotating roll to apply finish as shown in FIG. 1 was used as a control. The apparatus of FIGS. 2 and 3, with a zone 40, were used for the examples according to the invention.

Reported fiber properties are linear density and tensile properties, measured conventionally, as dictated by ASTM methods.

Linear density was measured according to ASTM D 1577 and reported as denier per filament.

Elongation-to-break and break-tenacity were measured according to ASTM D 3822 where elongation is reported as a percentage based on the original sample length and breaking force is reported in grams normalized by filament denier.

Example 1

This example compares inter-filament denier and elongation-to-break variability for the conventional quench control and the current invention. The product was prepared from polyethylene terephthalate polymer containing 0.2% delusterant composed of titanium oxides with an intrinsic viscosity of 0.65 as measured in 25/75 trichlorophenol/phenol solution. The polymer was extruded at 295° C. through a capillary with diameter of 0.25 mm and 0.5 mm in length at a rate of 0.39 gm/min/capillary. The extruded filaments were arranged in an annular array and cooled with quench air directed radially inward at a speed of 1.2 m/s and beginning approximately 20 mm below the spinneret plate. The quench air was conditioned to 22° C. and 65% relative humidity and extended for a length of 200 mm.

The finish applicator was located approximately 1 m below the quench zone for the control and 500 mm below the quench zone 30 for the current invention. The finish applicator diameter was fixed at 105% of the outer filament array. The applicators delivered an aqueous solution of 0.7% by weight conditioning oil. The conditioning oil comprised emulsified surfactants for the purpose of friction and static control within the filament bundle. The added moisture to the filament was approximately 10% by weight in both cases.

The filaments were collected at a speed of 1800 m/min on a bobbin winder and analyzed for tensile and denier uniformity. The as-spun product had a single filament vibrational denier of 2.13, elongation-to-break of 220%, and breaking tenacity of 2.6 g/den for both control and test items. Product variability was determined from the analysis of 200 single filament measurements and is reported as both sample variance and percent coefficient of variation (% CV) in Table 1. The sample variance considers the position of each observation relative to the mean as the sum of deviations squared normalized by the sample count less one. The % CV is defined as the square root of the sample variance normalized by the sample mean and expressed as a percentage. The sample mean is determined by the sum of individual observations divided by the total sample count. Based on the sample variance analysis, the current invention reduces product variability by 35% for elongation and by 64% for linear density.

The spun product was subsequently stretched and annealed in a conventional drawing process to yield a staple product with a linear density of 0.96 denier, a tenacity of 6.4 g/den, and elongation-to-break of 23% for both control and invention.

TABLE 1

Table 1-Sample variance and % CV for break-elongation and filament denier of product from prior art and current invention showing better uniformity for the current invention.

| | Control | | Current Invention | |
|---|---|---|---|---|
| | Variance | % CV | Variance | % CV |
| Elongation-to-break | 351 | 8.4 | 228 | 6.9 |
| Denier per filament | 0.033 | 8.5 | 0.012 | 5.3 |

Example 2

This example illustrates quality improvement for higher capillary production rates or higher filament linear density using the apparatus according to the present invention. The polymer supply, quench and finish arrangement were identical to Example 1 with the exception of a capillary diameter of 0.32 mm and a production rate of 0.67 gm/min/capillary.

The filaments were collected at a speed of 1780 m/min on a package winder and analyzed for tensile and denier uniformity. Product variability was determined from the analysis of 100 single filament measurements with the sample mean and sample variance recorded in Table 2.

TABLE 2

Table 2-Sample variance and mean for break-elongation and filament denier of product from prior art and current invention showing better uniformity for the current invention.

| | Control | | Current Invention | |
|---|---|---|---|---|
| | Mean | Variance | Mean | Variance |
| Elongation-to-break | 240% | 366 | 220% | 217 |
| Denier per filament | 3.53 | 0.087 | 3.41 | 0.032 |

Example 3

This example illustrates the improved uniformity for the application of the conditioning oil obtained with the present invention relative to the control. The applicators described in FIG. 1 and FIG. 2 delivered an aqueous solution of 0.7% by weight emulsified surfactants. The added moisture to the filament was approximately 10% by weight in both cases. The finish level on the fiber is reported as weight percent of conditioning oil present on the final product after drying. The sample mean and % CV were determined from the measurement of 16 samples taken at different time intervals from the process in Example 1. Sample means and % CV are reported in Table 3 and calculated as described in Example 1. Results for the % CV indicate the temporal uniformity of finish application is improved by the current invention.

TABLE 3

| | Control | | Current Invention | |
|---|---|---|---|---|
| | Mean | % CV | Mean | % CV |
| Finish level (% w/w) | .071 | 27.2% | .069 | 5.1% |

Although the invention has been described above in detail for the purpose of illustration, it is understood that the skilled artisan may make numerous variations and alterations without departing from the spirit and scope of the invention defined by the following claims.

What is claimed is:

1. A melt spinning apparatus for spinning continuous polymeric filament comprising:

(a) a spinneret having a plurality of capillaries;

(b) a polymer delivery system which is arrange to communicate with said spinneret and deliver molten polymer there through to produce a continuously moving array of molten polymeric filaments corresponding to the arrangement of capillaries in the spinneret;

(c) a quench zone positioned positioned below said spinneret and arranged to receive and cool the array of molten filaments as they move through by passing a cooling gas inward with respect to the array of moving filaments; and (d) a finish applicator positioned inside or below the quench zone to apply an amount of finishing liquid to the array, wherein said finish applicator comprises:

(i) a base plate having a peripheral edge which corresponds to the cross-section of the array of moving molten filaments; and (ii) a tapered shaped body portion, the tapered shaped body having an angle beta (β) in the range of about 45 degrees to about 170 degrees for smoothly deflecting accumulated quench air from inside the filament array to outside the array and having a top and bottom concentric therewith and connected to said base plate, wherein said bottom corresponds in shape to the shape defined by the peripheral edge of the base plate, and having a surface formed by a plurality of lines drawn between said top and said bottom tapering outwardly with respect to the direction of movement of the filament array.

2. The apparatus of claim 1, further comprising a means for moving the finish applicator into and out of the array of filament.

3. The apparatus of claim 1, wherein said quench zone is a radial, cross-flow, or pneumatic quench zone.

4. The apparatus of claim 1, wherein said applicator is a conical-shaped finish applicator.

5. The apparatus of claim 1, wherein the finish applicator includes a filament contact surface coated with ceramic oxide.

6. The apparatus of claim 1, wherein said finish applicator comprises one or more peripheral finish delivery slots that communicates with a peripheral fiber contact surface.

7. The apparatus of claim 1, wherein said finish applicator is positioned a distance ranging from 120 mm to 200 mm below said spinneret.

8. The apparatus of claim 1, wherein said finish applicator is positioned a distance ranging from 200 mm to 400 mm below said quench zone.

9. The apparatus of claim 1, wherein the array of the filaments being annular comprise an inner and an outer filament array diameter that determine the diameter of said finish applicator in a range of 70% to 120% of the outer filament array diameter.

10. A melt spinning apparatus for spinning continuous polymeric filaments, comprising a finish applicator to apply an amount of finishing liquid to an array of filaments, positioned inside or below a quench zone that is arranged to receive a stream of cooling gas directed radially inward, wherein said finish applicator comprises:

(i) a base plate having a peripheral edge which corresponds to the cross-section of the array of moving molten filaments; and (ii) a tapered shaped body portion, the tapered shaped body having an angle beta (β) in the range of about 45 degrees to about 170 degrees for smoothly deflecting accumulated quench air from inside the filament array to outside the array and having a top and bottom concentric therewith and connected to said base plate, wherein said bottom corresponds in shape to the shape defined by the peripheral edge of the base plate, and having a surface formed by a plurality of lines drawn between said top and said bottom tapering outwardly with respect to the direction of movement of the filament array.

11. The melt spinning apparatus of claim 10, wherein the finish applicator further comprises a peripheral delivery slot for delivering the finishing liquid to the filament array, and wherein said peripheral delivery slot communicates with a peripheral fiber contact surface on an outer surface of the body portion.

12. The melt-spinning apparatus of claim 11, wherein the finish applicator further comprises an arm having channels for delivery and drainage of said finishing liquid, wherein said arm supports said finish applicator and further wherein said arm is connected to said peripheral delivery slot.

13. The melt spinning apparatus of claim 10, wherein said finish applicator is mounted on a linear motion device.

14. A melt spinning apparatus for spinning continuous polymeric filaments, comprising a finish applicator to apply an amount of finishing liquid to an array of filaments, positioned inside or below a quench zone that is arranged to receive a stream of cooling gas directed inward, wherein said finish applicator comprises (i) a base plate having a peripheral edge which corresponds to the cross-section of the array of moving molten filaments; and (ii) a tapered shaped body portion, the tapered shaped body having an angle beta (β) in the range of about 45 degrees to about 170 degrees for smoothly deflecting accumulated quench air from inside the filament array to outside the array and having a top and bottom concentric therewith and connected to said base plate, wherein said bottom corresponds in shape to the shape defined by the peripheral edge of the base plate, and having a surface formed by a plurality of lines drawn between said top and said bottom tapering outwardly with respect to the direction of movement of the filament array.

* * * * *